United States Patent [19]

Nakajima et al.

[11] 4,210,109

[45] Jul. 1, 1980

[54] MULTI-CYLINDER INTERNAL COMBUSTION ENGINE

[75] Inventors: Yasuo Nakajima, Yokosuka; Michio Onoda, Yokohama; Kunihiko Sugihara, Takasho; Shinichi Nagumo, Yokohama, all of Japan

[73] Assignee: Nissan Motor Company, Limited, Yokohama, Japan

[21] Appl. No.: 856,533

[22] Filed: Dec. 1, 1977

[30] Foreign Application Priority Data

Dec. 2, 1976 [JP] Japan ..... 51/145126

[51] Int. Cl.[2] ..... F02D 33/02

[52] U.S. Cl. ..... 123/76; 123/570 C; 123/59 EC

[58] Field of Search ..... 123/75 B, 76, 119 C, 123/119 CE, 198 F, 59 EC, 119 A

[56] References Cited

U.S. PATENT DOCUMENTS

| | | | |
|---|---|---|---|
| 1,048,922 | 12/1912 | Westaway | 123/76 |
| 1,138,077 | 5/1915 | Buchi | 123/198 F |
| 1,297,248 | 3/1919 | Ricardo | 123/76 |
| 1,431,547 | 10/1922 | Smith | 123/76 |
| 1,512,710 | 10/1924 | Potter | 123/75 B |
| 1,576,357 | 3/1926 | Pierce | 123/75 B |
| 1,629,530 | 5/1927 | Reineke | 123/198 F |
| 3,092,089 | 6/1963 | Dolza | 123/76 |
| 3,799,133 | 3/1974 | Frank | 123/119 A |
| 3,805,752 | 4/1974 | Cataldo | 123/59 EC |
| 3,963,000 | 6/1976 | Kosaka et al. | 123/119 A |

*Primary Examiner*—Charles J. Myhre
*Assistant Examiner*—Jeffrey L. Yates
*Attorney, Agent, or Firm*—Schwartz, Jeffery, Schwaab, Mack, Blumenthal & Koch

[57] ABSTRACT

An internal combustion engine has at least one cylinder acting as an air pump for the admission of scavenging air into the remaining cylinders.

17 Claims, 7 Drawing Figures

MULTI-CYLINDER INTERNAL COMBUSTION ENGINE

BACKGROUND OF THE INVENTION

This invention relates to an engine system including a multi-cylinder internal combustion engine which has a scavenging phase and more particularly to the construction of a multi-cylinder internal combustion engine using one cylinder as an air pump for the admission of scavenging air.

It is recognized that, in the conventional engine, a portion of exhaust gas tends to remain in each cylinder when the exhaust stroke has terminated and the amount of such residual gas will increase under partial load conditions, causing unstable engine operation under these conditions. Thus, if the residual gas is expelled from the cylinder with scavenging air and replaced with the air, the admission of more fuel could be effected and the probability of misfiring due to the presence the residual gas lowers. This makes it possible to improve engine power output and fuel economy.

To this end, it is known to admit scavenging air under pressure into the engine cylinders to forcibly expel the residual gas from the cylinder. An engine system embodying this known idea comprises an air pump which is driven in timed relationship with the engine r.p.m. to increase the amount of scavenging air in response to the engine speed because there is the tendency that the residual gas increases as the engine speed increases. The problem in this system, however, is that the air pump is drivably connected to the engine crankshaft through a complicated linkage to synchronize the air pump with the engine speed. Another problem is that there can not be found enough room in the engine compartment for accommodating the air pump and complicated linkage. Since the air pump which is capable of effecting the admission of air under sufficiently high pressure is expensive, this is also a problem.

SUMMARY OF THE INVENTION

It is therefore an object of the invention to provide an engine system in which the above mentioned problems have been eliminated.

It is another object of the invention to provide a multi-cylinder internal combustion engine in which at least one of the cylinders is used as an air pump for the admission of scavenging air into the remaining cylinders.

BRIEF DESCRIPTION OF THE DRAWINGS

The invention will be further described hereinafter in connection with the accompanying drawings, in which.

DESCRIPTION OF THE PREFERRED EMBODIMENTS

Figure 1:
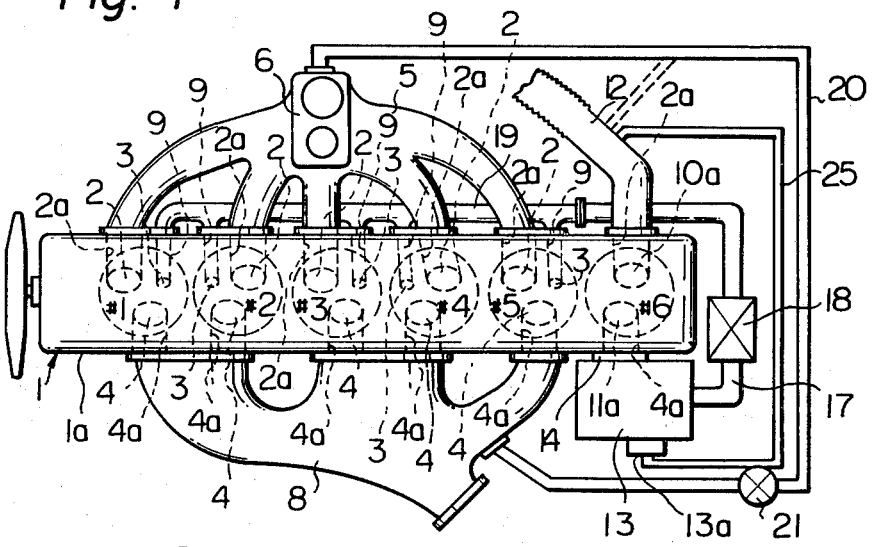
FIG. 1 is a schematic view of an engine system comprising a multi-cylinder internal combustion engine of the invention.

An engine system shown in FIG. 1 comprises a four-stroke reciprocatory internal combustion engine 1 which has an engine block 1*a* formed with six cylinders arranged in a line. These cylinders will be denoted at #1 to #6, respectively for the ease of explanation. A cylinder head 1*b* is secured to the engine block 1*a* to close the cylinders and has six inlet port bores 2*a* opening to the cylinders, respectively, six outlet port bores 4*a* opening to the cylinders, respectively, and five additional inlet port bores 9 opening to the #1 to #5 cylinders, respectively. The cylinder head supports five intake valves 2 respectively closing the inlet port bores 2*a* opening to #1 to #5 cylinders, five exhaust valves 4 respectively closing the outlet port bores 4*a* opening to the #1 to #5 cylinders and five air inlet valves 3 respectively closing additional inlet port bores 9 opening to the #1 to #5 cylinders. An inlet manifold 5 connects a carburetor 6 to the five inlet port bores 2*a* for distributing an air fuel mixture prepared by the carburetor 6 to these cylinders. An outlet or exhaust manifold 8 is connected to the outlet port bores 4*a* opening to the #1 to #5 cylinders to receive exhaust gas discharged from these cylinders. An air supply gallery 19 connects an outlet of a surge tank 13 to the additional inlet port bores 9 opening to the #1 to #5 cylinders through a conduit 17 to distribute air to these cylinders. Six pistons, only one being shown in FIG. 2 at 15, are slidable in the #1 to #6 cylinders, respectively for reciprocable movement therein and operatively connected to a crankshaft, not shown, in a known manner. The admission of air fuel mixture into the #1 to #5 cylinders and the discharge of exhaust gas from these cylinders are effected by the intake and exhaust valves 2 and 4 in a known manner. The admission of air into the #1 to #5 cylinders is effected by the air inlet valves 3 during a period extending from the end portion of the exhaust stroke to the beginning portion of the intake stroke to perform a scavenging phase.

The #6 cylinder acts as a pump to transfer air, under pressure above atmospheric pressure, to the additional inlet port bores 9 through the surge tank 13, conduit 17 and air gallery 19. A conduit 12 connects an air cleaner, not shown, to the air inlet port bore 2*a* opening to the #6 cylinder and another conduit 14 connects the outlet port bore 4*a* opening to the #6 cylinder to an inlet of the surge tank 13. An intake valve, in the form of a check valve 10*a*, is mounted within the conduit 12 to close the inlet port bore 2*a* and a discharge valve, in the form of a check valve 11*a*, is mounted within the conduit 14 to close the outlet port bore 4*a*, as shown in FIG. 2.

The admission of air into the #6 cylinder is effected during the downward stroke of the piston 15 by means of the intake check valve 10*a*, while the discharge of air from the #6 cylinder is effected during the upward stroke of the piston 15 by means of the discharge check valve 11*a*. These check valves 10*a* and 11*a* are designed to perform this operation. It will be noted that the discharge of air, under pressure, from the #6 cylinder is effected once per each revolution of the crankshaft, while, the discharge of exhaust gas from every one of the #1 to #5 cylinders is effected once per every two revolutions of the crankshaft.

Figure 2:
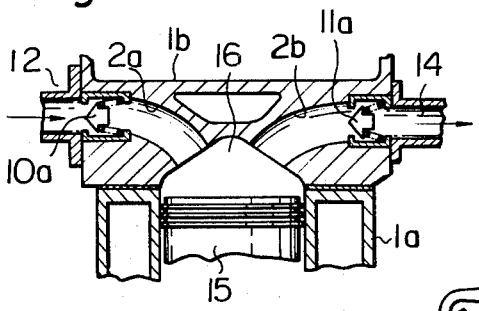
FIG. 2 is an axial sectional view through a portion of one cylinder of the engine shown in FIG. 1.

The check valve 10*a* shown in FIG. 2 is designed such that it opens when the internal pressure within the cylinder chamber 16 drops to or is below a predetermined level, while the discharge check valve 11*a* is designed such that it opens when the internal pressure rises and is above another predetermined level which is set higher than the former predetermined level.

Figure 3:
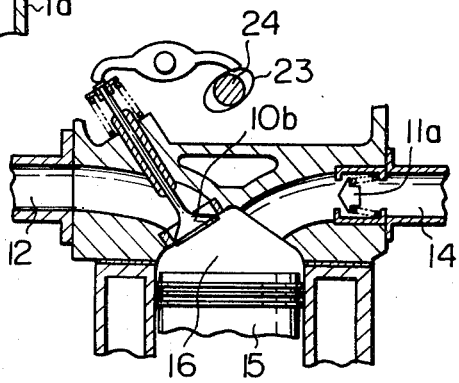
FIG. 3 is a similar view to FIG. 2 showing another embodiment of the invention.

In the embodiment shown in FIG. 3, an intake valve takes the form of a poppet valve 10*b* which opens once per each downward stroke of the piston 15 to effect admission of air into the #6 cylinder. The poppet valve 10*b* is actuated by means of a valve operating mechanism comprising a cam mounted to a cam shaft carrying cams for controlling the intake and exhaust valves associated with the #1 to #5 cylinders. A discharge valve in this embodiment is a similar check valve 11*a* as shown in FIG. 2. Although not shown the discharge valve may take the form of a poppet valve, if desired.

Air discharged, under pressure, from the #6 cylinder enters the surge tank 13 and then passes through conduit 17 and air gallery 19 toward the air inlet port bores 9. The flow rate through the conduit 17 is controlled by means of a flow control device 18. The control device 18 controls the flow rate in response to engine operating conditions.

Denoted by 20 is an EGR conduit leading from exhaust manifold 8 to inlet manifold 5 at a location downstream of the carburetor 6. Flow of exhaust gas passing through the EGR conduit is controlled by an EGR control valve 21. The EGR control valve 21 controls the flow rate through the EGR conduit 20 in response to the engine venturi vacuum. Recirculated exhaust gas is admitted into the #1 to #5 cylinders together with air fuel mixture from the carburetor. If desired, a portion of the exhaust gas within exhaust manifold 8 may be admitted into the #6 cylinder, for example, through line 60 (FIG. 1) for later admission into the #1 to #6 cylinders through air inlet valves 3.

Figure 4:
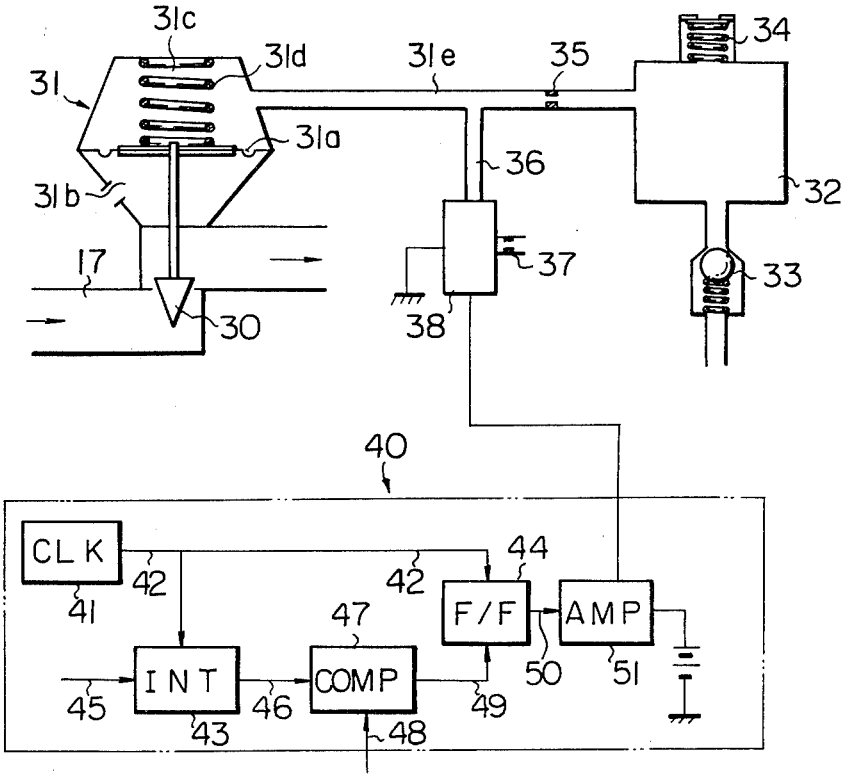
FIG. 4 is a diagrammatic view of the flow control device shown in FIG. 1.
Figures 5A, 5B:
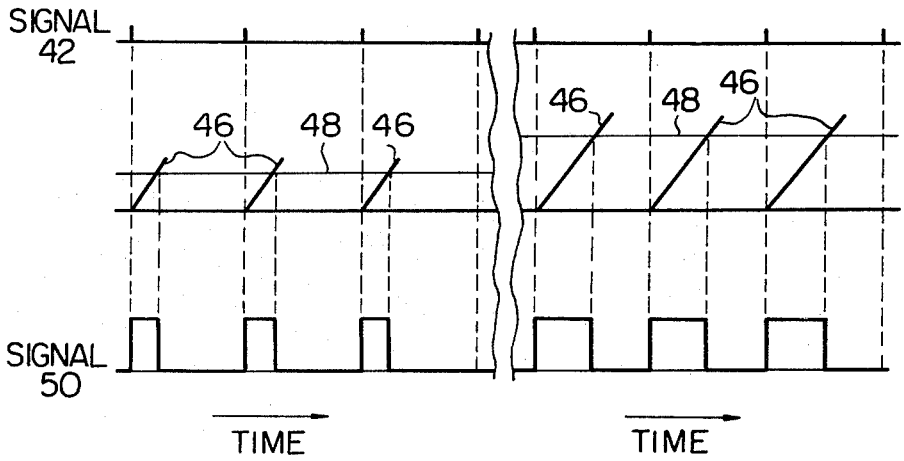
FIGS. 5A and 5B are timing diagrams of signals from the control circuit shown in FIG. 4.
Figure 6:
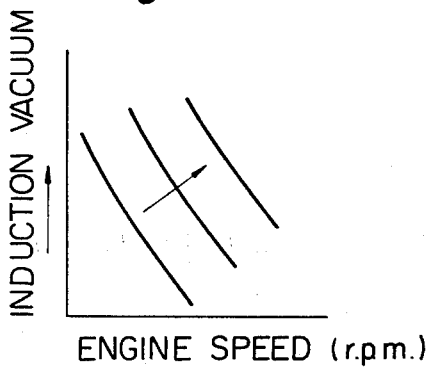
FIG. 6 is a graph showing the required admission of air through the additional intake port bore as a function of the engine speed and induction vacuum.

Going into the detail of the flow control device 18, with reference to FIGS. 4 to 6, a flow control valve 30 is disposed in the conduit 17 (see FIG. 4). A vacuum servo 31 is mounted on the conduit 17 and has a diaphragm 31*a* to which the valve stem of the valve 30 is fixedly connected, an atmospheric chamber 31*b* below (viewing FIG. 4) the diaphragm 31*a*, a vacuum chamber 31*c* above (viewing FIG. 4B) the diaphragm 31*a*, and a spring 31*d* mounted within the vacuum chamber 31*c* to act against the diaphragm 31*a* to bias the valve 30 to the illustrated closed position in which the conduit 17 is closed by the valve 30. A vacuum conduit 31*e* connects the outlet of a source of constant vacuum, in the form of a vacuum accumulator 32, to the vacuum chamber 31*c*. The vacuum accumulator 32 is connected to the source of the engine induction vacuum through a check valve 33. A pressure regulator 34 is mounted on the vacuum accumulator 32 to keep the pressure within the accumulator 32 constant irrespective of the engine operating conditions. The vacuum conduit 31*e* is provided with an orifice 35 therein and an air bleed conduit 36 has one end connected to the vacuum conduit 31*e* at a location intermediate the orifice 35 and the vacuum chamber 31*c*. An air bleed orifice 37 is provided within the air bleed conduit 36 at an opposite end thereof. A solenoid valve 38 is arranged to control flow through the air bleed conduit 36. When not energized, the solenoid valve 38 closes the air bleed conduit 37, while, when energized, it opens the air bleed conduit 36. A control circuit 40, only diagrammatically shown in FIG. 4, is electrically circuited with the solenoid valve 38.

The control circuit 40 shown in FIG. 4 comprises a clock counter 41 which generates a reset signal 42 at regular intervals. The reset signal 42 is fed to an integrator 43 and also to a flip flop 44 to reset them. An electrical signal 45 representing the engine speed (the engine r.p.m.) is fed to the integrator 43. An output signal voltage 46 from the integrator 43 rises at a faster rate when the engine speed is high than when the engine speed is low. This output signal voltage 46 is fed to a comparator 47 to which a reference signal voltage 48 representing the engine induction vacuum is fed. The reference signal voltage 48 is higher when the engine induction vacuum is high, i.e., when engine load is low, than when the induction vacuum is low, i.e., when engine load is high. The comparator 47 feeds a reset signal 49 to the flip flop 44 when the signal 46 exceeds the signal 48. Since time period after the instance of the reset signal 42 to the instance of the reset signal 49 is variable in response to the engine speed and induction vacuum, the flip flop 44 will produce a pulse signal 50 having a pulse width variable in response to the engine speed and induction vacuum. This pulse signal 50 is amplified by means of an amplifier 51 and then used to energize the solenoid valve 38 so that the solenoid will be energized for a time corresponding to the pulse width.

FIG. 5A shows a timing diagram representing the condition that the engine speed is high and induction vacuum is low, while FIG. 5B shows a timing diagram representing the condition that the engine speed is low and induction vacuum is high. FIG. 6 shows a graph plotting the required amount of scavenging air for expelling the residual gas from a cylinder as against the engine speed and induction vacuum. It will now be understood that with the valve 30 the amount of scavenging air will be varied along the graph shown in FIG. 6.

In operation, the piston 15 in the #6 cylinder will be driven to reciprocate therein by the pistons in the #1 to #5 cylinders through the crankshaft. During the downward stroke, the piston 15 in the #6 cylinder draws air into the cylinder chamber 16 through conduit 12 and intake valve 10*a* (see FIG. 2) and as the piston moves upwardly, the air within the cylinder chamber 16 is compressed. During the end portion of the upward stroke, the discharge valve 11*a* opens to discharge the air from the cylinder toward the surge tank 13. The air is admitted into the surge tank 13 under pressure above atmospheric pressure. The surge tank 13 supplies air, under pressure, to all of the additional intake port bores 9 through conduit 17 and air gallery 19. The flow rate of air passing through the conduit 17 is controlled by the flow control device 18.

The provision of surge tank 13, which stores air at high pressure above atmospheric pressure, will make it possible to insure enough air for meeting varying demands against variations of operating conditions of the engine, without any delay.

The flow rate of air passing through conduit 17 is a function of the pressure within the surge tank 13, engine speed and induction vacuum.

Since the pressure of air discharged from the #6 cylinder varies according to the engine speed, it is preferable to provide a relief valve 13*a* in order to keep the pressure within surge tank 13 constant. Precise control of the flow rate of air passing through conduit 17 is possible by the flow control device 18 alone because compensation for variation of pressure within the surge tank 13 is unnecessary. Preferably, air relieved from surge tank 13 through relief valve 13a is admitted into the #6 cylinder through a conduit 25 (see FIG. 1) so as to boost the combustion efficiency of the engine.

During the period overlapping the exhaust stroke and intake stroke when the air inlet valve opens, the admission of scavenging air, under pressure above atmospheric pressure, is effected. Thus, the residual gas is expelled from the #1 to #5 cylinders and the cylinders can be charged with more air fuel mixture during the intake stroke. This results in an increase of actual volume of per each cylinder by as much as the amount of residual gas expelled from the cylinder, thus increasing engine power and decreasing fuel consumption.

Preferably, scavenging air is admitted to swirl within the cylinder to increase scavenging effeciency and swirl the air fuel mixture inducted. The amount of scavenging air per each admission should be substantially equal to or greater than the amount of residual gas.

It will be appreciated that although the amount of residual gas increases when the induction vacuum increases, such as, under idle and deceleration conditions of the engine, the amount of scavenging air is controlled to meet the demands for idle and deceleration conditions by the flow control device 18 because it is responsive to the induction vacuum.

Because, in the case of the FIG. 3 embodiment, poppet valve 10b must be opened once per each reciprocating movement of piston 15 in the #6 cylinder, poppet valve 10b must be operated by a cam 23 provided with two valve operating sections which are arranged as diagonally opposite positions so that the cam 23 opens poppet valve 10b twice per each revolution of the engine cam shaft 24.

In the preceding embodiments, a conventional inline six cylinder internal combustion engine is modified according to the invention such that the No. 6 cylinder will act as an air pump. It is within the scope of the invention to use two cylinders of a conventional V-8 internal combustion engine as air pumps or to add one cylinder to a conventional four cylinder for use as an air pump.

In the preceding embodiments, for the cost advantage derived from the use of the conventional cylinder block, the crankshaft for a conventional 6-cylinder internal combustion engine is used. If desired, the pistons in the #1 to the #5 cylinders are operatively connected to crankshaft for a conventional 5-cylinder engine and the piston in the #6 cylinder is operated in timed relationship with one of the remaining pistons. In this case, balancing can be optimized by attaching a suitable balance weight to suppress engine vibration for smooth operation. If, instead of a carburetor, fuel injection is used, the conventional manifold for the conventional 6 cylinder engine can be used unmodified.

It will now be understood from the preceding description that, according to the invention, the admission of scavenging air is effected to meet demands for various engine operating conditions at a small cost increase because the conventional cylinder block currently under manufacture can be used without much modification.

It will also be understood that noise inherent to operation of air pump is reduced and operating life thereof prolongs because it is surrounded by the engine block.

It will be understood that the power loss due to use of one cylinder as an air pump could be compensated for by the other cylinders if enlarging the cylinder bores of them and by power increase resulting from the admission of scavenging air.

What is claimed is:

1. A multi-cylinder internal combustion engine comprising:

a cylinder block having a plurality of cylinders consisting of a first group of cylinders and at least one second cylinder;

a cylinder head secured to said cylinder block to close said cylinders;

a plurality of pistons slidably disposed in said plurality of cylinders, respectively, for reciprocal movement therein;

a first intake means for inducting air/fuel mixture into said first group of said cylinders;

an exhaust means for discharging exhaust gas from said first group of said cylinders;

a second intake means for inducting ambient air into said second cylinder;

a third intake means for admitting air discharged from said second cylinder into said first group of said cylinders, so as to scavenge hot residual exhaust gases from said first group of said cylinders;

an intake valve in said second intake means to control the induction of ambient air into each of said second cylinder(s);

a discharge valve in said third intake means to control the discharge of air from each of said second cylinders; and EGR means for recirculating a cooled portion of exhaust gases discharged from said first group of cylinders to said first intake means, said third intake means including a surge tank disposed downstream of said discharge valve to receive air from said discharge valve, and a relief valve and conduit means for admitting air relieved from said surge tank through said relief valve to said second intake means.

2. An engine as claimed in claim 1, in which said intake and discharge valves comprise check valves.

3. An engine as claimed in claim 1, in which said intake valve comprises a poppet valve which is actuable by a cam.

4. An engine as claimed in claim 3, in which said exhaust valve comprises a check valve.

5. An engine as claimed in claim 1, further comprising means operatively connected to said third intake means for controlling flow of said air discharged from said second cylinder and admitted into said first group of said cylinders.

6. An engine as claimed in claim 5, wherein said controlling means is operatively connected for controlling said air flow in dependence on at least one operating parameter of said engine.

7. An engine as claimed in claim 5, wherein said controlling means comprises a flow control valve disposed in said third intake means and having a control opening, said flow control valve operable in response to induction vacuum from said first intake means applied to said control opening.

8. An engine as claimed in claim 7, wherein said controlling means further comprises a solenoid valve connected for bleeding air to said control opening of said flow control valve in response to a control signal; and circuit means for supplying said control signal.

9. An engine as claimed in claim 8, wherein said circuit means comprises:

resettable integrating circuit means for supplying a first signal which increases at a rate dependent on the operating speed of said engine;

means for comparing said first signal with a second signal representing said induction vacuum from said first intake means, and for supplying a third signal when said first signal exceeds said second signal;

resettable flip-flop circuit means responsive to said third signal for supplying said control signal; and clock circuit means for periodically resetting said integrating circuit means and said flip-flop circuit means, whereby when said engine speed is relatively high and said induction vacuum is relatively low, said control signal comprises a series of periodic pulses having relatively narrow pulse widths, and when said engine speed is relatively low and said induction vacuum is relatively high, said control signal comprises a series of periodic pulses having relatively large pulse widths, said solenoid valve bleeding air to said control opening of said flow control valve in dependence on said periodic pulse widths.

10. A multi-cylinder internal combustion engine comprising:

a cylinder block having a plurality of cylinders consisting of a first group of cylinders and at least one second cylinder;

a cylinder head secured to said cylinder block to close said cylinders;

a plurality of pistons slidably disposed in said plurality of cylinders, respectively, for reciprocal movement therein;

a first intake means for inducting air fuel mixture into said first group of cylinders;

an exhaust means for discharging exhaust gas from said first group of cylinders;

a second intake means for inducting ambient air into said second cylinder(s);

a third intake means for admitting air discharged from said second cylinder into said first group of said cylinders, so as to scavenge hot residual exhaust gases from said first group of cylinders;

an intake in said second intake means to control the induction of ambient air into each of said second cylinder(s);

a discharge valve in said third intake means to control the discharge of air from each of said second cylinder(s), and a surge tank disposed downstream of said discharge valve to receive air from said discharge valve, said surge tank including a relief valve and conduit means for admitting air relieved from said surge tank through said relief valve to said second intake means.

11. An engine as claimed in claim 10, in which said intake and discharge valves comprise check valves.

12. An engine as claimed in claim 10, in which said intake valve comprises a poppet valve which is actuable by a cam.

13. An engine as claimed in claim 12, in which said exhaust valve comprises a check valve.

14. A four stroke reciprocating internal combustion engine comprising:

a cylinder block having a plurality of cylinders, said cylinders comprising a first group of cylinders and at least one second cylinder;

a plurality of pistons reciprocatively received in said cylinders;

a cylinder head secured to said cylinder block to close said cylinders, said cylinder head, said cylinders and said pistons cooperating to define a plurality of variable volume spaces in said cylinders;

a first intake means for inducting an air-fuel mixture into the variable volume spaces of said first group of cylinders during the intake stroke of the pistons received in said first group of cylinders;

exhaust means for exhausting the exhaust gas resulting from the combustion of said air-fuel mixture in the variable volume spaces of said group of cylinders during the exhaust stroke of each of the pistons received in said first group of cylinders;

a second intake means for inducting air into said second cylinder(s) during the intake stroke of each of the pistons received therein;

third intake means interconnecting the variable volume spaces of said first group of cylinders and the variable volume space of said second cylinder(s) for supplying pressurized air from said second cylinder(s) to said first group of cylinders, said pressurized air being supplied into each of said first group of cylinders during a scavenging phase which overlaps the exhaust stroke of the piston therein and during a swirl generating phase which overlaps the intake stroke of the piston, so as to swirl the air-fuel mixture around the cylinder axis of the respective cylinder;

control means interposed in said third intake means for controlling the supply of pressurized air from said second cylinder(s) to said first group of cylinders, said control means including a surge tank for storing pressurized air, a flow control valve responsive to engine operating parameters for controlling the release of air from said surge tank and a relief valve for relieving excess pressurized air from said surge tank into said second intake means; and EGR means interconnecting said exhaust means and said first intake means for recirculating a portion of the exhaust gases exhausted from said first group of cylinders to said first intake means.

15. An internal combustion engine comprising:

a cylinder block having a plurality of cylinders;

a cylinder head secured to said cylinder block to close said cylinders;

a plurality of pistons movably disposed in said plurality of cylinders, respectively;

at least a first one of said cylinders functioning as a pump for pressurizing air;

a first induction system for sypplying air into said first cylinder;

a second induction system for supplying a combustible charge into the remaining of said cylinders;

an exhaust system for receiving exhaust gases discharged from said remaining cylinders;

a third induction system interconnecting said first cylinder and the remaining cylinders for supplying pressurized air from said first cylinder into the remaining cylinders, said third induction system including a surge tank for storing pressurized air, a flow control valve responsive to engine operating parameters for releasing said pressurized air from said surge tank and a pressure relief valve for relieving excess pressurized air from said surge tank into said second induction system; and an EGR system interconnecting said exhaust system and one of said first and second induction systems for recirculating a portion of said exhaust gases from said exhaust system to said one of said first and second induction systems, whereby hot residual exhaust gases are scavenged from the cylinders supplied with combustible charge by the pressurized air from said third induction system, permitting increased charging efficiency of fresh charge containing cool EGR gas.

16. A multi-cylinder internal combustion engine comprising:

a cylinder block having a plurality of cylinders consisting of a first group of cylinders and at least one second cylinder;

a cylinder head secured to said cylinder block to close said cylinders;

a plurality of pistons slidably disposed in said plurality of cylinders, respectively, for reciprocal movement therein;

a first intake means for inducting air/fuel mixture into said first group of said cylinders;

an exhaust means for discharging exhaust gas from said first group of said cylinders;

a second intake means for inducting ambient air into said second cylinder;

a third intake means for admitting air discharged from said second cylinder into said first group of said cylinders, so as to scavenge hot residual exhaust gases from said first group of said cylinders;

an intake valve in said second intake means to control the induction of ambient air into each of said second cylinder(s);

a discharge valve in said third intake means to control the discharge of air from each of said second cylinders;

EGR means for recirculating a cooled portion of exhaust gases discharged from said first group of cylinders to said first intake means; and means operatively connected to said third intake means for controlling flow of said air discharged from said second cylinder and admitted into said first group of said cylinders, said controlling means comprising a flow control valve disposed in said third intake means and having a control opening, said flow control valve being operable in response to induction vacuum from said first intake means applied to said control opening and a solenoid valve connected for bleeding air to said control opening of said flow control valve in response to a control signal; and circuit means for supplying said control signal.

17. An engine as claimed in claim 16, wherein said circuit means comprises:

resettable integrating circuit means for supplying a first signal which increases at a rate dependent on the operating speed of said engine;

means for comparing said first signal with a second signal representing said induction vacuum from said first intake means, and for supplying a third signal when said first signal exceeds said second signal;

resettable flip-flop circuit means responsive to said third signal for supplying said control signal; and clock circuit means for periodically resetting said integrating circuit means and said flip-flop circuit means, whereby when said engine speed is relatively high and said induction vacuum is relatively low, said control signal comprises a series of periodic pulses having relatively narrow pulse widths, and when said engine speed is relatively low and said induction vacuum is relatively high, said control signal comprises a series of periodic pulses having relatively large pulse widths, said solenoid valve bleeding air to said control opening of said flow control valve in dependence on said periodic pulse widths.

* * * * *